US007246591B2

(12) United States Patent
Shinogi et al.

(10) Patent No.: US 7,246,591 B2
(45) Date of Patent: Jul. 24, 2007

(54) AUTOMATIC CHOKE CONTROL SYSTEM FOR GENERAL-PURPOSE ENGINE

(75) Inventors: Yoshihisa Shinogi, Wako (JP); Tomoki Fukushima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/477,549

(22) Filed: Jun. 30, 2006

(65) Prior Publication Data

US 2007/0012287 A1 Jan. 18, 2007

(30) Foreign Application Priority Data

Jul. 13, 2005 (JP) ..... 2005-204864

(51) Int. Cl.
*F02D 41/06* (2006.01)

(52) U.S. Cl. ..... 123/179.18; 261/64.6; 123/185.3

(58) Field of Classification Search ..... 123/179.18, 123/179.16, 185.3; 261/64.6
See application file for complete search history.

(56) References Cited

U.S. PATENT DOCUMENTS 4,463,723 A * 8/1984 Tansuwan ..... 261/39.4
2005/0200030 A1* 9/2005 Kamimura et al. ..... 261/39.1
2006/0037574 A1* 2/2006 Matsuda et al. ..... 123/179.18

FOREIGN PATENT DOCUMENTS

JP 61-070159 A 4/1986
JP 61-081530 A 4/1986
JP 2004-232529 A 8/2004

* cited by examiner

*Primary Examiner*—Noah P. Kamen
*Assistant Examiner*—Arnold Castro
(74) *Attorney, Agent, or Firm*—Westerman, Hattori, Daniels & Adrian, LLP.

(57) ABSTRACT

In an auto-choke system for a general-purpose engine, it is determined whether the operator has operated a combination switch to enable ignition in the engine and based on the result of this determination, the operation of a choke motor (actuator) is controlled to regulate the opening of the choke valve, specifically the operation of the choke motor is controlled to fully open the choke valve when ignition is found to be disabled. As a result, jetting of fuel is minimized and flooding prevented when the recoil starter is manipulated with ignition disabled. In addition, the operation of the choke motor is controlled to fully close the choke valve when ignition is found to be enabled, thereby enhancing the starting performance of the engine.

4 Claims, 4 Drawing Sheets

AUTOMATIC CHOKE CONTROL SYSTEM FOR GENERAL-PURPOSE ENGINE

BACKGROUND OF THE INVENTION

1. Field of the Invention

This invention relates to an automatic choke control system for a general-purpose or industrial engine.

2. Description of the Related Art

In recent years, automatic choke control systems for improving engine starting performance by utilizing an actuator to open and close a choke valve have come to be applied to general-purpose internal combustion engines used as prime movers in generators, agricultural machines and various other equipment, as taught, for example, by the automatic choke control system set forth in Japanese Laid-Open Patent Application No. 2004-232529.

General-purpose engines are commonly equipped with recoil starters. When starting an engine with a recoil starter, the operator manipulates the recoil starter after first activating the ignition system by turning on an associated ignition switch. Most general-purpose engines use a carburetor to supply fuel. If the recoil starter is manipulated when the choke valve is closed, the carburetor jets a large amount of fuel even if the ignition switch has still not been turned on and ignition is disabled. In this case, the ignition plug is wetted by the fuel, i.e., flooding occurs, and firing becomes hard to achieve after the ignition switch is turned on.

SUMMARY OF THE INVENTION

An object of this invention is therefore to overcome this problem by providing an automatic choke control system for a general-purpose engine that prevents flooding by inhibiting the jetting of fuel when the recoil starter is manipulated with ignition disabled.

In order to achieve the object, this invention provides a system for controlling an automatic choke including a choke valve installed in an air intake passage of a general-purpose engine and an actuator for moving the choke valve, comprising: a switch located to be operable by an operator and when operated, enabling ignition in the engine; a recoil starter located to be manipulatable by the operator and when manipulated, starting the engine, a determiner determining whether the switch is operated when the recoil starter is manipulated; and a controller controlling operation of the actuator to regulate opening of the choke valve based on a determination result of the determiner.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An automatic choke control system for a general-purpose engine according to a preferred embodiment of the present invention will now be explained with reference to the attached drawings.

Figure 1:
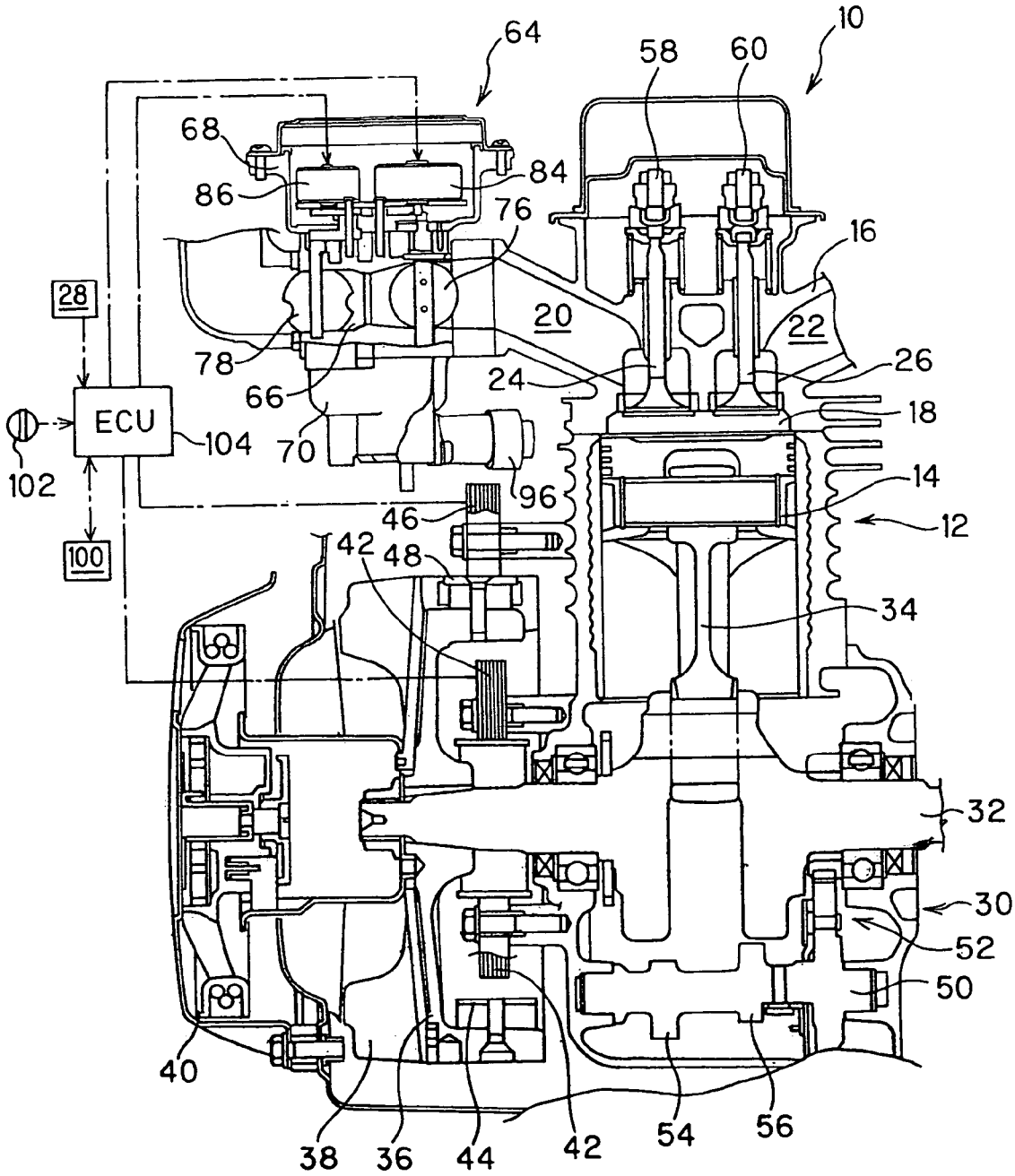
FIG. 1 is a diagram of an overall automatic choke control system for a general-purpose engine according to the preferred embodiment.

FIG. 1 is a diagram of the overall automatic choke control system for a general-purpose engine according to the preferred embodiment.

Reference numeral 10 in FIG. 1 designates a general-purpose or industrial engine. The engine 10 is an air-cooled, four-cycle, single-cylinder OHV model with a displacement of, for example, 400 cc. The engine 10 is suitable for use as the prime mover of a generator, agricultural machine or any of various other kinds of equipment.

The engine 10 has a cylinder (cylinder block) 12 accommodating a piston 14 that can reciprocate therein. A cylinder head 16 is attached to the top of the cylinder 12. A combustion chamber 18 is formed in the cylinder head 16 so as to face the crown of the piston 14. An intake port 20 and an exhaust port 22 are provided in communication with the combustion chamber 18. The cylinder head 16 is provided with an intake valve 24 for opening and closing communication between the combustion chamber 18 and the intake port 20, and an exhaust valve 26 for opening and closing communication between the combustion chamber 18 and the exhaust port 22. It is also provided with a temperature sensor 28 for producing an output indicating the temperature of the engine 10.

A crankcase 30 is attached to the bottom of the cylinder block 12. A crankshaft (output shaft) 32 is installed in the crankcase 30 to be rotatable therein. The crankshaft 32 is connected to the bottom of the piston 14 through a connecting rod 34.

A generator or other load (not shown) is connected to one end of the crankshaft 32. A flywheel 36, cooling fan 38 and recoil starter 40 are attached to the other end thereof. The recoil starter 40 starts the engine when manually manipulated or operated by the operator.

The flywheel 36 is shaped like a case and a power coil 42 is installed inside the case-like flywheel 36. The power coil 42 and a magnet 44 attached to the inner surface of the flywheel 36 together constitute a multi-polar generator that produces an output, i.e., alternating current synchronous with rotation of the crankshaft 32.

A pulser coil 46 is installed outside the flywheel 36. The pulser coil 46 produces an output indicating the ignition timing of the engine 10 every time a magnet 48 attached to the outer peripheral surface of the flywheel 36 passes by. Although omitted in FIG. 1, a coil for fuel-cut solenoid valve (FS coil) is installed inside the flywheel 36 together with the power coil 42. The FS coil also produces and output, i.e., alternating current synchronous with the rotation of the crankshaft 32.

A camshaft 50 is also installed in the crankcase 30 to be rotatable therein. The camshaft 50 is aligned in parallel with the axis of the crankshaft 32 and is connected to the crankshaft 32 through a gear mechanism 52. The camshaft 50 is equipped with an intake side cam 54 and an exhaust side cam 56, which operate through push rods (not shown) and rocker arms 58, 60 to open and close the intake valve 24 and exhaust valve 26. A carburetor 64 is connected to the intake port 20.

Figure 2:
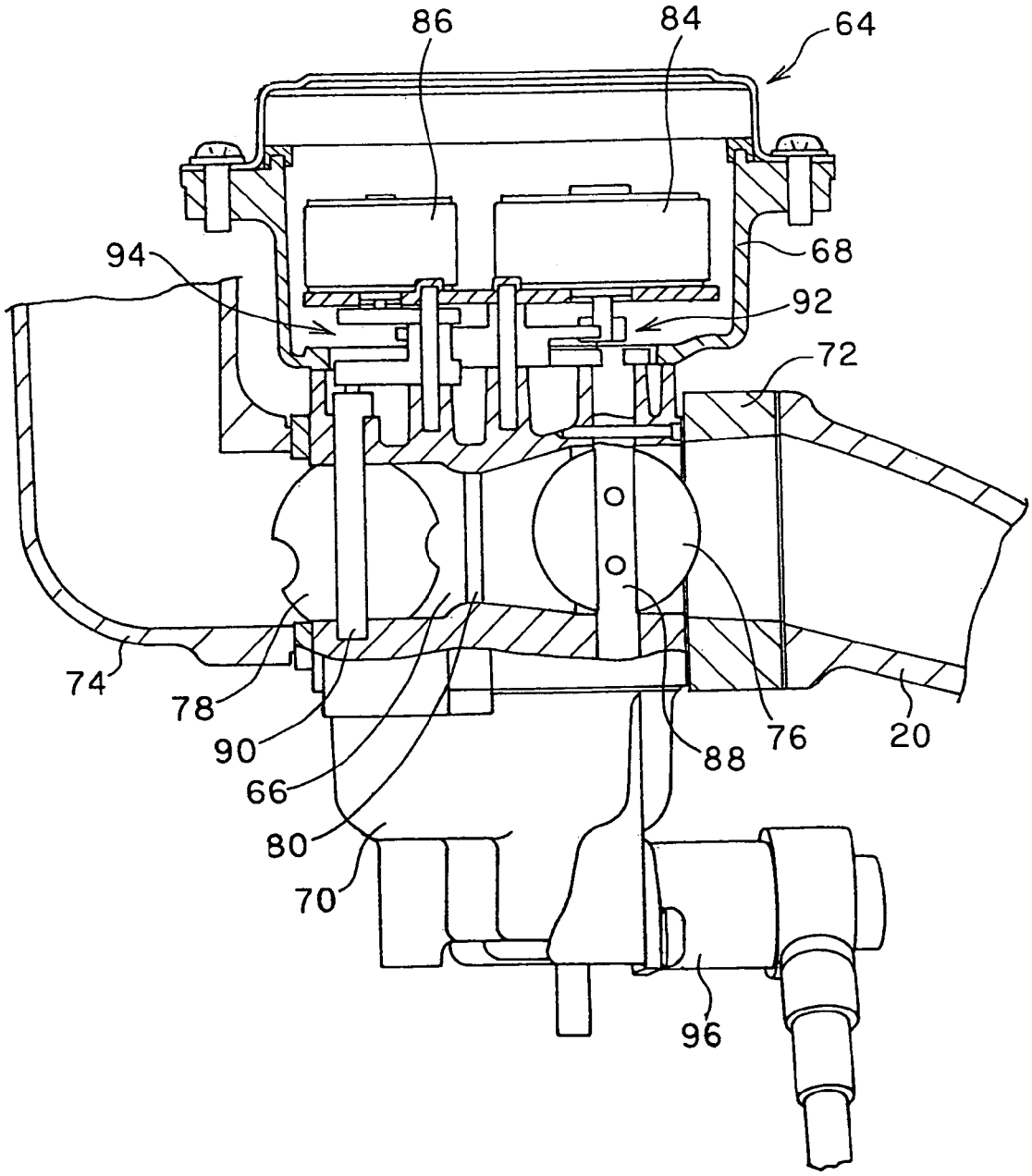
FIG. 2 is an enlarged sectional view of a carburetor shown in FIG. 1.

An enlarged sectional view of the carburetor 64 is shown in FIG. 2.

As shown in FIG. 2, the carburetor 64 unitarily comprises an air intake passage 66, motor case 68 and carburetor assembly 70. The downstream side of the air intake passage 66 is connected through an insulator 72 to the intake port 20, and the upstream side thereof is connected through an air-cleaner elbow 74 to an air-cleaner (not shown). A throttle valve 76 is installed in the air intake passage 66 and a choke valve 78 is also installed in the air intake passage 66 on the upstream side of the throttle valve 76. The air intake passage 66 is reduced in diameter between the choke valve 78 and throttle valve 76 to form a venturi 80.

An electric throttle motor 84 for moving (opening and closing) the throttle valve 76 and an electric choke motor 86 for moving (opening and closing) the choke valve 78 are housed in the motor case 68. The throttle motor 84 and choke motor 86 are stepper motors each comprising a stator wound with a coil and a rotor. The rotational shaft 88 of the throttle valve 76 is connected through a reduction gear mechanism 92 to the output shaft of the throttle motor 84. The rotational shaft 90 of the choke valve 78 is connected through reduction a gear mechanism 94 to the output shaft of the choke motor 86.

Although not shown in the drawings, the carburetor assembly 70 comprises a float chamber connected to a fuel tank, a main nozzle connected to the float chamber through a main jet and a main fuel line, and an idle port and a slow port connected to a slow fuel line branching from the main fuel line. The main nozzle is installed at a position where it faces into the venturi 80. The idle port and slow port are installed at positions where they face into the vicinity of the throttle valve 76.

When the opening of the throttle valve 76 is large, fuel is jetted from the main nozzle owing to the negative pressure of the intake air (generated by the descending stroke of the piston 14) passing through the venturi 80, thereby producing an air-fuel mixture. When the opening of the throttle valve 76 is small, fuel is jetted from the idle port or the slow port owing to the negative pressure of the intake air passing through the throttle valve 76. When the choke valve 78 is closed, the negative pressure in the air intake passage 66 is increased, thereby increasing the amount of jetted fuel and producing a rich air/fuel ratio.

Reference numeral 96 in FIG. 2 designates the aforesaid fuel-cut solenoid valve. The valve member (not shown) of the fuel-cut solenoid valve 96 is installed between the float chamber and main jet. When the FS coil (shown in FIG. 3) of the fuel-cut solenoid valve 96 is energized, the valve member closes to block passage of fuel.

Returning to the explanation of FIG. 1, the air-fuel mixture produced in the foregoing manner passes through the intake port 20 and intake valve 24 to be sucked into the combustion chamber 18. The air-fuel mixture sucked into the combustion chamber 18 is ignited by a spark plug (shown in FIG. 3) and bums. The resulting combustion gas is discharged to outside the engine 10 through the exhaust valve 26, the exhaust port 22, a muffler (not shown).

A combination switch 100 and an engine speed setting switch 102 are installed at locations to be operated by the operator. The combination switch 100 is connected to an electronic control unit (ECU) 104 constituted as a microcomputer. The engine speed setting switch 102 is responsive to operation by the operator for producing an output indicating the engine speed desired by the operator. The outputs of the temperature sensor 28, power coil 42, pulser coil 46 and engine speed setting switch 102 are sent to the ECU 104. Based on the operator's operation of the combination switch 100 and the other inputs, the ECU 104 controls the operation of the engine 10 (e.g., the operation of the throttle motor 84 and choke motor 86).

Figure 3:
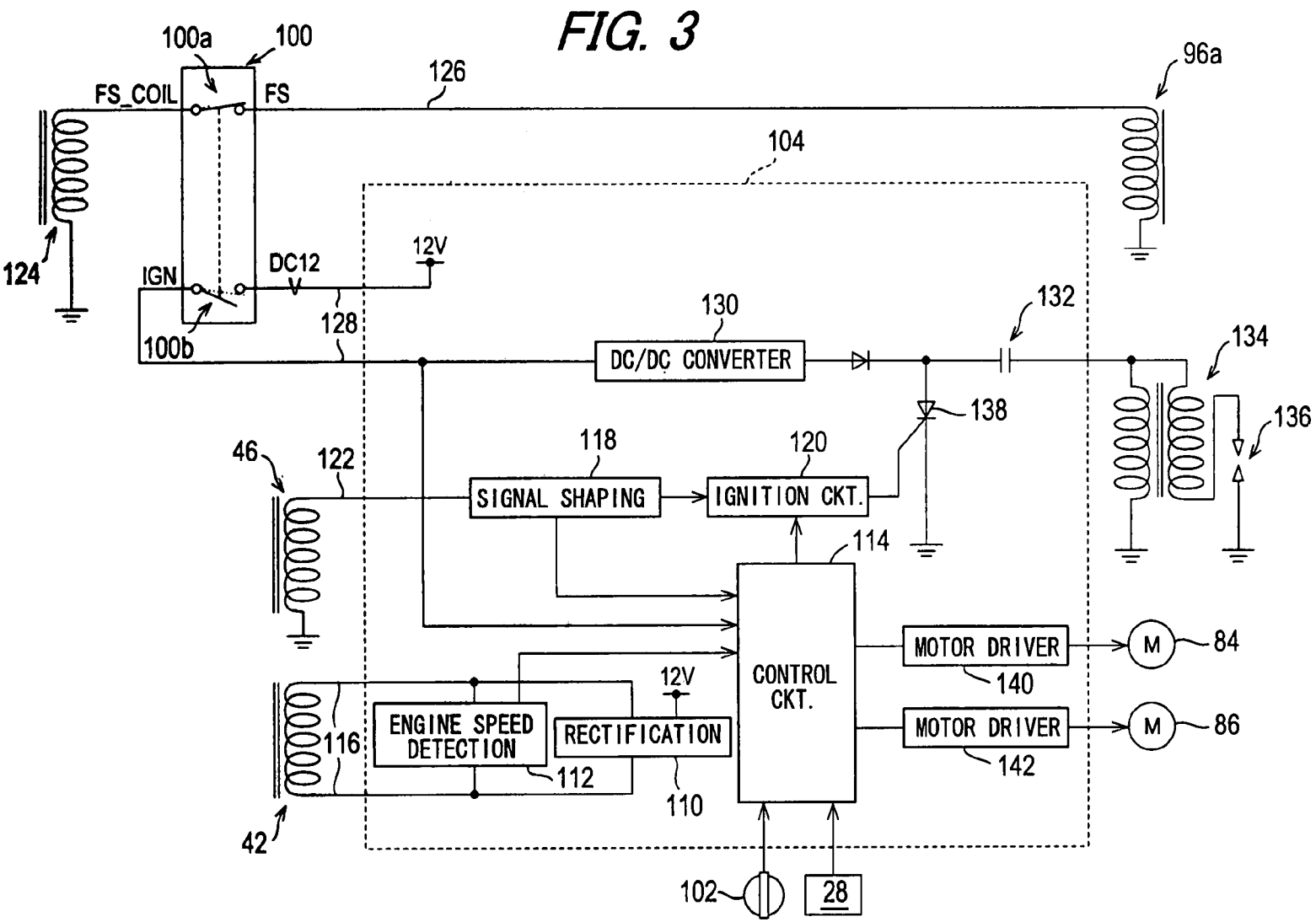
FIG. 3 is an explanatory diagram showing the configuration of an ECU and other components shown in FIG. 1.

FIG. 3 is an explanatory diagram showing the configuration of the ECU 104 and other components.

The ECU 104 is equipped with a rectification circuit 110, engine speed (NE) detection circuit 112, and control circuit 114. The output of the power coil 42 is forwarded through a conductor 116 to the rectification circuit 110 of the ECU 104, where it is converted to 12V direct current by full-wave rectification.

The output of the power coil 42 is sent to the engine speed detection circuit 112, where it is converted to a pulse signal. The pulse signal generated by the engine speed detection circuit 112 is inputted to the control circuit 114. The frequency of the alternating current generated by the power coil 42 is proportional to the rotating speed (rpm) of the crankshaft 32. The control circuit 114 can therefore use the pulse signal converted from the output of the power coil 42 to determine the engine speed (rpm).

The ECU 104 is further equipped with a signal shaping circuit 118 and an ignition circuit 120. The output of the pulser coil 46 is sent through a conductor 122 to the signal shaping circuit 118, where it is used to generate an ignition signal synchronous with the rotation of the crankshaft 32. The ignition signal generated by the signal shaping circuit 118 is sent to the ignition circuit 120 and control circuit 114.

The combination switch 100 is equipped with a first switch **100*a* and a second switch 100*b*. The first switch 100*a* is disposed in a conductor 126 interconnecting the FS coil (now assigned with reference symbol 124) and a coil 96*a* of the fuel-cut solenoid valve 96 for enabling and disabling flow of current through the conductor 126. The second switch 100*b* is disposed in a conductor 128 for enabling and disabling flow of current through the conductor 128**.

When the second switch **100*b* is closed, the 12V direct current generated from the output of the power coil 42 passes out of the ECU 104 and is then returned thereto through the conductor 128 and the second switch 100*b*. The current returning to the ECU 104 is applied to the control circuit 114 and a DC/DC converter 130. The 12V direct current generated from the output of the power coil 42 is converted to 5V direct current in another circuit (not shown) and this 5V direct current is supplied to the control circuit 114** as operating current.

The DC/DC converter 130 steps up the voltage of the current supplied thereto to charge a capacitor 132 by the increased voltage. The capacitor 132 is connected to the primary coil of an ignition coil 134. The secondary coil of the ignition coil 134 is connected to the spark plug (now indicated as 136). The circuit connecting the DC/DC converter 130 to the capacitor 132 is grounded through a thyristor 138.

The ignition circuit 120 applies current to the gate of the thyristor 138 in accordance with an ignition signal inputted from the signal shaping circuit 118 or control circuit 114. The capacitor 132 therefore discharges through the primary coil of the ignition coil 134 and the resulting high voltage generated across the secondary coil causes the spark plug 136 to spark.

The temperature sensor 28 and engine speed setting switch 102 are connected to the control circuit 114. Based on the outputs of the temperature sensor 28, engine speed setting switch 102 and engine speed detection circuit 112, the control circuit 114 determines and outputs control signals to the motor drivers 140, 142, thereby controlling the operation of the throttle motor 84 and choke motor 86 so as to regulate the openings of the valves 76, 78 and thus regulate fuel injection quantity, in other words engine speed. Based on the signals, the control circuit 114 also regulates the ignition timing and other operations.

The operator can set the combination switch 100 to the ON position or OFF position as desired. In FIG. 3, the solid lines indicate the state of the switches 100*a*, 100*b* when the combination switch 100 is in the OFF position and the imaginary lines indicate their state with it is in the ON position.

When the combination switch 100 is put in the ON position, the first switch 100*a* is turned OFF to cut off the supply of operating current to the fuel-cut solenoid valve 96, and the second switch 100*b* is turned ON to pass current through the conductor 128. The fuel-cut solenoid valve 96 is normally open, so that cutting off the supply of operating current thereto enables jetting of fuel from the carburetor 64.

When the recoil starter 40 is manipulated with the combination switch 100 in the ON position, the resulting rotation of the crankshaft 32 causes the power coil 42 and pulser coil 46 to produce outputs. As a result, 12 V direct current and an ignition signal are generated to activate the ECU 104 and start the engine 10.

When the combination switch 100 is put in the OFF position, the supply of current to the ignition system is cut off to terminate ignition and stop the engine 10. When the engine 10 stops, the 12 V direct current is no longer generated and the ECU 104 therefore shuts down. Thus setting the combination switch 100 to the ON position enables ignition in the engine 10 and setting it to the OFF position disables ignition.

In addition, putting the combination switch 100 in the OFF position turns the first switch 100*a* ON to interconnect the FS coil 124 and the coil 96*a* of the fuel-cut solenoid valve 96. The FS coil 124 continues to generate electricity even after ignition is terminated because rotation of the crankshaft 32 does not stop immediately. The fuel-cut solenoid valve coil 96*a* therefore continues to receive operating current from the FS coil 124 for a certain period of time after the combination switch 100 is put in the OFF position to close the fuel-cut solenoid valve 96. Ignition cutoff and fuel cutoff are consequently performed simultaneously.

Even when the combination switch 100 is in the OFF position, manipulating the recoil starter 40 produces negative pressure in the air intake passage 66. In this event, therefore, the large amount of fuel is jetted from the carburetor assembly 70 when the choke valve 78 is closed. However, the fuel is not ignited because the combination switch 100 is in OFF position, so that the jetted fuel does not burn but adheres to the ignition plug, i.e., flooding occurs, to make firing hard to achieve after the combination switch 100 is turned ON. The rotation of the crankshaft 32 produced by manipulating the recoil starter 40 is too slow to generate enough current to close the fuel-cut solenoid valve 96.

In the automatic choke control system for a general-purpose engine according to this invention, therefore, it is determined whether the operator has manipulated the combination switch 100 so as to enable ignition in the engine 10 and the operation of the choke motor 86 is controlled to regulate the opening of the choke valve 78 accordingly.

Figure 4:
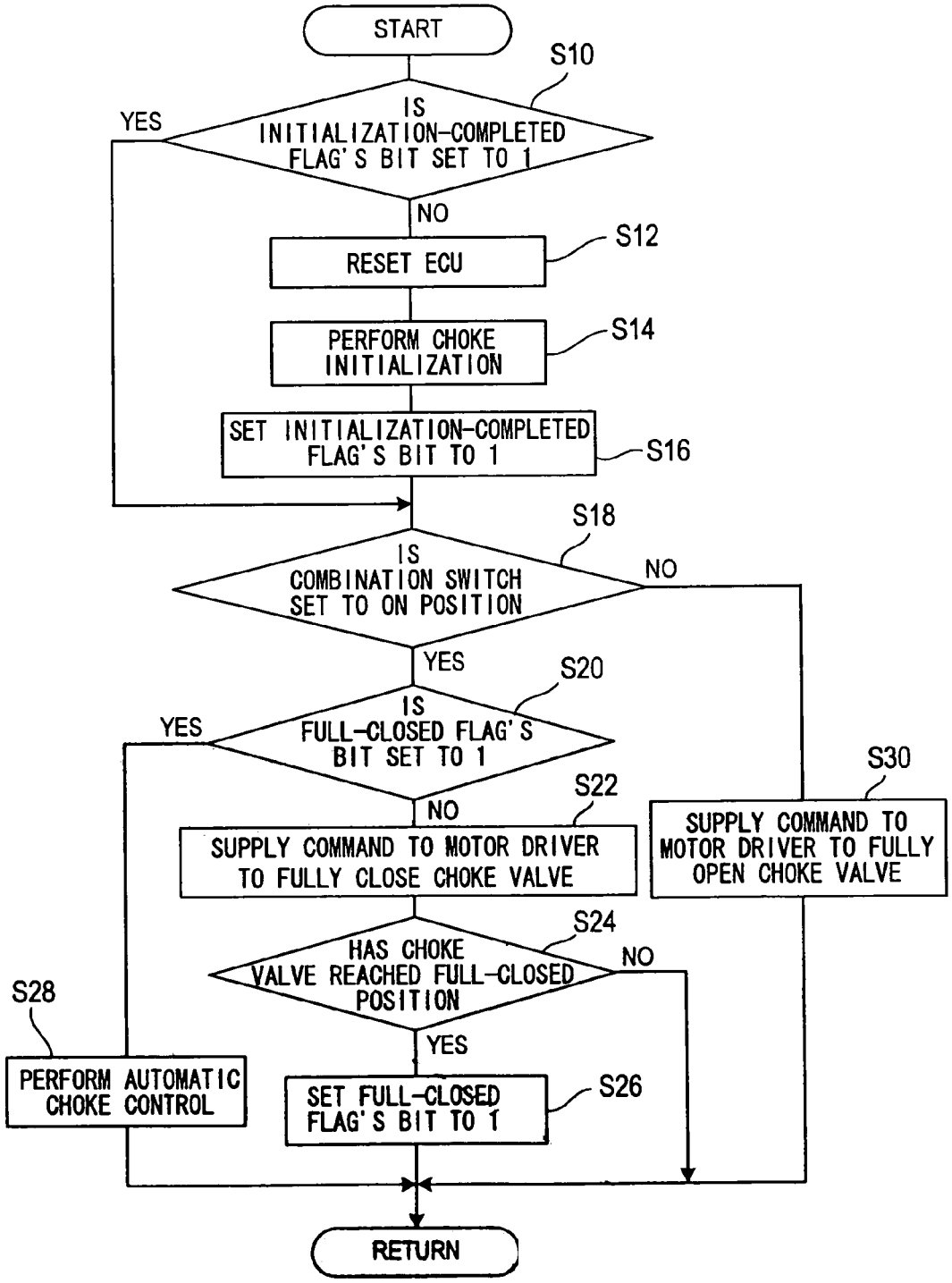
FIG. 4 is a flowchart showing the sequence of processing operations for regulating opening of a choke valve executed in the ECU shown in FIG. 1.

FIG. 4 is a flowchart showing the sequence of processing operations for regulating the opening of the choke valve 78. The ECU 104, more exactly, the control circuit 114 executes the illustrated program at regular intervals (e.g., every 10 milliseconds).

An explanation of the flowchart of FIG. 4 follows. The processing operations begin when the ECU 104 is powered on by current generated by the power coil 42 just after the operator manipulates the recoil starter 40.

First, in S10, it is determined whether the bit of an initialization-completed flag (initial value 0) is set to 1. When the result in S10 is NO, the program goes to S12, in which the ECU 104 is reset, to S14, in which choke initialization is performed, i.e., the initial step position of the choke stepper motor 86) is stored in memory, and to S16, in which the initialization-completed flag is set to 1. Once the bit of the initialized flag has been set to 1 in S16, the result in S10 becomes YES and S12 to S16 are skipped in the next and ensuing cycles.

Next, in S18, it is determined whether the combination switch 100 is set in the ON position, i.e., whether ignition is enabled. This is done by checking whether the control circuit 114 is receiving current through the conductor 128.

When the result in S18 is YES, i.e., when it is found that the combination switch 100 is in ON position and ignition is enabled, the program goes to S20, in which it is determined whether the bit of a full-closed flag (initial value 0) is set to 1.

On the other hand, when the result in S20 is NO, the program goes to S22, in which a full-closed command (control signal) is supplied to the motor driver 142 to fully close the choke valve 78, whereby operation of the choke motor 86 is controlled to fully close the choke valve 78.

Next, in S24, it is determined whether the choke valve 78 has reached the full-closed position. The determination in S24 is performed based on the output of a rotation angle sensor (not shown) for detecting the opening of the choke valve 78.

When the result in S24 is YES, the program goes to S26, in which the bit of the full-closed flag is set to 1, and when it is NO, S26 is skipped. When the bit of the full-closed flag has been set to 1 in S26, the result in S20 becomes YES in the next and ensuing cycles.

When the result in S20 is YES, the program goes to S28, in which automatic choke control is performed. Specifically, the operation of the choke motor 86 is controlled based on the output of the temperature sensor 28, thereby regulating the opening of the choke valve 78.

When the result in S18 is NO, i.e., when it is found that the combination switch 100 is in OFF position and ignition is disabled, the program goes to S30, in which a full-open command (control signal) is supplied to the motor driver 142 to fully open the choke valve 78, whereby the operation of the choke motor 86 is controlled to fully open the choke valve 78. In other words, the choke valve 78 is fully opened to minimize fuel jetting when ignition is disabled at the time of manipulating the recoil starter 40.

As set forth in the foregoing, the automatic choke control system for a general-purpose engine according to this preferred embodiment is configured to determine whether the operator has operated the combination switch 100 to enable ignition in the engine 10 (whether the combination switch 100 has been put in the ON position) and respond to the result of this determination by controlling the operation of the choke motor 86 to regulate the opening of the choke valve 78, specifically by controlling the operation of the choke motor 86 to fully open the choke valve 78 when ignition is found to be disabled (when the combination switch 100 is found to be in the OFF position). As a result, jetting of fuel is minimized and flooding prevented when the recoil starter 40 is manipulated with ignition disabled.

In addition, the automatic choke control system for a general-purpose engine is configured to control the operation of the choke motor 86 to fully close the choke valve 78 when ignition is found to be enabled (the combination switch 100 is found to be in the ON position), thereby enhancing the starting performance of the engine 10.

The embodiment is thus configured to have a system for controlling an automatic choke including a choke valve (78) installed in an air intake passage (66) of a general-purpose engine (10) and an actuator (electric choke motor 86) for moving the choke valve, comprising: a switch (combination switch 100) located to be operable by an operator and when operated, enabling ignition in the engine; a recoil starter (40) located to be manipulatable by the operator and when manipulated, starting the engine; a determiner (ECU 104, S18) determining whether the switch is operated when the recoil starter is manipulated; and a controller (ECU 104, S22, S30) controlling operation of the actuator to regulate opening of the choke valve based on a determination result of the determiner.

In the system, the controller controls the operation of the actuator such that the choke valve is opened if the switch is not operated when the recoil starter is manipulated (ECU 104, S30).

In the system, the controller controls the operation of the actuator such that the choke valve is closed if the switch is operated when the recoil starter is manipulated (ECU 104, S22).

In the system, the switch comprises a combination switch (100) having a first switch (100*a*) that closes a fuel-cut solenoid valve (96) to block passage of fuel in a carburetor (64) when made on and a second switch (100*b*) that enables the ignition in the engine when made on, and the combination switch (100) is configured such that the second switch (100*b*) is made on only when the first switch (100*a*) is made off.

Although the actuator for opening and closing the choke valve 78 is exemplified as an electric motor, more specifically stepper motor in the foregoing description, it can instead be any of various other kinds of actuator or electric motor. Although it is explained that only the opening of the choke valve 78 is regulated based on the position of the combination switch 100, it is possible also to simultaneously regulate the position of the throttle valve 76.

Moreover the location of the combination switch 100 is not limited to that in the foregoing embodiment. For example, the switch can be positioned to ground the connection between the power supply system and the ignition so that ignition can be enabled by putting it in the OFF position.

Japanese Patent Application No. 2005-204864 filed on Jul. 13, 2005, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling an automatic choke including a choke valve installed in an air intake passage of a general-purpose engine and an actuator for moving the choke valve, comprising:

a switch located to be operable by an operator and when operated, enabling ignition in the engine;

a recoil starter located to be manipulatable by the operator and when manipulated, starting the engine;

a determiner determining whether the switch is operated when the recoil starter is manipulated; and a controller controlling operation of the actuator to regulate opening of the choke valve based on a determination result of the determiner.

2. The system according to claim 1, wherein the controller controls the operation of the actuator such that the choke valve is opened if the switch is not operated when the recoil starter is manipulated.

3. The system according to claim 1, wherein the controller controls the operation of the actuator such that the choke valve is closed if the switch is operated when the recoil starter is manipulated.

4. The system according to claim 1, wherein the switch comprises a combination switch having a first switch that closes a fuel-cut solenoid valve to block passage of fuel in a carburetor when made on and a second switch that enables the ignition in the engine when made on, and the combination switch is configured such that the second switch is made on only when the first switch is made off.

* * * * *